US006105529A

United States Patent [19]

Kyle

[11] Patent Number: 6,105,529

[45] Date of Patent: Aug. 22, 2000

[54] HATCH ADJUSTER

[75] Inventor: James H. Kyle, Charleston, N.H.

[73] Assignee: Pompanette, Inc., Charlestown, N.H.

[21] Appl. No.: 09/193,253

[22] Filed: Nov. 17, 1998

Related U.S. Application Data

[60] Provisional application No. 60/065,765, Nov. 17, 1997.

[51] Int. Cl.[7] ..... B63B 19/12

[52] U.S. Cl. ..... 114/201 R

[58] Field of Search ..... 114/201 R, 203; 292/262, 263, 275; 296/60, 100.06, 216.02; 49/153, 246, 253

[56] References Cited

U.S. PATENT DOCUMENTS

| | | | |
|---|---|---|---|
| 1,985,427 | 12/1934 | Richardson | 287/85 |
| 2,071,203 | 2/1937 | Hubbs | 292/263 |
| 3,437,059 | 4/1969 | Stonier et al. | 108/151 |
| 3,861,083 | 1/1975 | Goiot | 49/193 |
| 3,976,024 | 8/1976 | Fillery | 114/203 |
| 4,160,607 | 7/1979 | Reichow | 103/286 |
| 4,215,885 | 8/1980 | McCray | 292/338 |
| 4,819,300 | 4/1989 | Jackson | 16/327 |
| 4,869,552 | 9/1989 | Tolleson | 297/296 |
| 5,950,252 | 9/1999 | Fettes | 4/498 |

*Primary Examiner*—Ed Swinehart
*Assistant Examiner*—Ajay Vasudeva
*Attorney, Agent, or Firm*—Dougherty & Troxell

[57] ABSTRACT

A hatch assembly for a marine vessel includes an outer frame and a hatch cover hingedly attached to the outer frame on one side thereof. The assembly also includes an elongated hatch adjuster comprising a telescoping rod assembly which includes an outer tube, a tubular extension and a flexible coupling which connects the tubular extension and outer tube in axial alignment when in a first position. The rod is slidably received within the outer tube and tubular extension and maintains the assembly in axial alignment as the hatch cover is rotated from a closed position to an angle of at least about 135°. As the hatch cover approaches 180°, the rod is withdrawn out of the outer tube which permits the flexible coupling to bend so that the hatch cover can be rotated a full 180°. The hatch assembly also includes a clamp for fixing the rod and outer tube in a fixed position to thereby maintain the cover in a preselected position with respect to the frame.

8 Claims, 6 Drawing Sheets

HATCH ADJUSTER

This application claims the benefit of an earlier filed U.S. provisional application, Ser. No. 60/065,765 which was filed on Nov. 17, 1997.

FIELD OF THE INVENTION

This invention relates to a hatch assembly for marine vessels or the like and more particularly to a marine hatch adjuster that allows a hatch cover to be rotated through 180° as it is opened or closed.

BACKGROUND OF THE INVENTION

For many years, hatch adjusters have been in widespread use to hold up hatch covers and deck hatches. Typically, they include a pair of telescoping tubes of various cross sections, preferably round, that slide one inside of another. Their lengths are then determined by varying the distance between the attachment points when the hatch is opened or closed.

Another form of hatch adjuster incorporates a relatively thick spring that is designed to fold in half when the hatch is in the closed position. In such adjusters there is normally no adjustment in length and the length of the spring and its attachment points determine the position of the opened hatch. It is possible that the spring could be mounted on a track to make the open position adjustable, but it is presently believed that this approach is overly complicated.

The spring adjuster does have one advantage. For example, to close the hatch, you push on the middle of the spring to force the spring out of column and cause it to bend. This makes closing easy and fast. However, the disadvantage is that if a hatch assembly is fitted with a single spring adjuster and the spring is accidentally bumped, the hatch cover will fall down and possibly cause severe bodily injury. To alleviate this problem, two adjusters are typically fitted to the assembly. Then it is necessary that both springs be bent to close the hatch.

When a hatch needs to open more than 90°but less than 130° any of the above adjusters may be used. However, when the cover has to rotate through 180° an added problem is introduced. In such cases, the lower end of the adjuster strikes the frame unless it has an appropriate bend. For example, a boat hatch with an adjuster that permits 180° rotation is disclosed in the U.S. Pat. No. 3,976,024. Incorporating bends in the adjuster may weaken the adjuster and at the same time causes the arm to protrude into the hatch opening by several inches. This protrusion into the cabin adversely affects headroom and prevents the attachment of a screen to be fitted up in the hatch cavity.

Accordingly, it is presently believed that there is a large commercial market for an improved hatch assembly as disclosed herein. There should be a relatively large market because the assemblies include an adjuster that permits 180° rotation of the hatch cover, are relatively safe i.e. less likely to be inadvertently or accidentally closed and do not adversely impact the headroom in the cabin of a vessel. It is also believed that the improved hatch assembly in accordance with the present invention can be manufactured, sold and installed at a competitive price. Such assemblies are also durable and allow a hatch cover to be fixed at an opened position at almost any angle of up to 180°. Such covers also overcome the likelihood of the cover being inadvertently or accidentally slammed shut.

BRIEF SUMMARY OF THE INVENTION

In essence, the present invention contemplates an improved hatch assembly for fitting within an opening in the wall or deck of a marine vessel. The hatch assembly includes an outer frame for fitting within an opening in the deck and a hatch cover. It also includes hinge means for hingedly connecting the cover to the frame on one side thereof. The hatch is then opened or closed by rotating the cover about the hinge. The hatch assembly also includes an elongated hatch adjuster which is connected at one end thereof to the frame and at an opposite end thereof to the hatch cover. This elongated hatch adjuster comprises a telescoping rod assembly which includes an outer tube, a tubular extension and a flexible coupling which connects the tubular extension and the outer tube in an end to end abutting or nearby abutting relationship. The outer tube and tubular extension are also maintained in axial alignment as the hatch cover is rotated through about 135°. The adjuster also includes an elongated rod which extends through the tubular extension and flexible coupling and into the outer tube where the hatch is opened to about 135° or less. The rod is slidably received within the outer tube, tubular extension and flexible coupling. Releasable means are also provided for fixing the rod at a preselected extension within the outer tube to thereby fix the hatch cover in a preselected open or closed position with respect to the frame. The releasable means also allows the rod to be withdrawn out of the outer tube, but within the tubular extension. Then, when the rod is withdrawn out of the outer tube but within the tubular extension, the flexible coupling is forced to bend by striking the frame as the hatch cover is rotated through an angle of up to 180°.

The invention will now be described in connection with the accompanying drawings wherein like reference numerals have been used to designate like parts.

DETAILED DESCRIPTION OF THE PREFERRED EMBODIMENTS OF THE INVENTION

Figure 1:
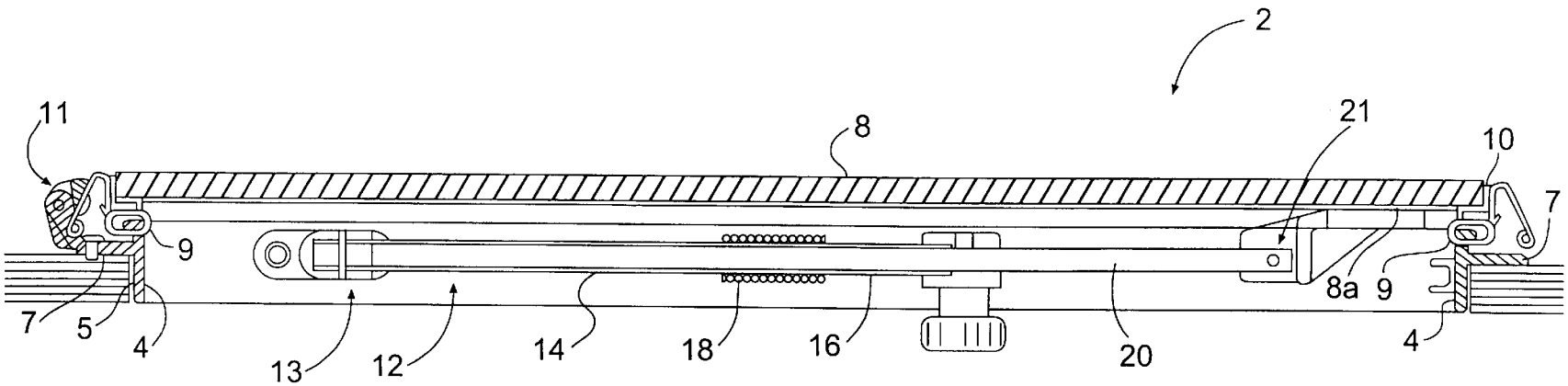
FIG. 1 is a cross sectional view of a hatch assembly in accordance with a first embodiment of the invention wherein the hatch assembly is in a fully closed position.

As illustrated, in FIGS. 1–4, a marine hatch assembly 2 is disposed within an opening in the deck of a marine vessel. The hatch assembly 2 is shown in its closed position in FIGS. 1 and 4, in a first opened position in FIG. 2*a* and its fully opened position in FIG. 3*a*. As illustrated, the hatch assembly 2 includes a hatch cover 8 or as sometime referred to in the art, a lens element. This hatch cover 8 may be made of a clear, tinted or opaque plastic panel or the like. As illustrated, the hatch cover 8 has a generally rectangular shape, but may have other forms.

The hatch cover 8 has a peripheral area which is bounded by and adjacent to an outer edge 10. The assembly 2 also includes a ring-shaped frame member 4 which may be of aluminum, plastic or light material as will be well understood by those of ordinary skill in the art. The frame member 4 has a shape which is similar to but somewhat larger than the hatch cover 8. For example, in one embodiment of the invention, as shown more clearly in FIG. 4, the frame member 4 and hatch cover 8 have similar and mating generally rectangular shapes. A resilient gasket means 9 is preferably disposed between the frame member 4 and hatch cover 8 in a conventional manner to form a seal that prevents water from entering the cabin of the vessel.

In a preferred embodiment of the invention, the frame member 4 has an L-shaped cross section which includes an inwardly directed (toward the interior of the vessel) segment and a peripheral segment 7 which extends outwardly away from the center of the hatch and generally parallel with the deck, wall or roof of the vessel in which the assembly 2 is installed.

The frame member 4 and hatch cover 8 may take various forms such as the one disclosed in my copending application entitled "Hatch Assembly for a Marine Vessel," Ser. No. 08/937,735 which was filed on Sep. 25, 1997 now U.S. Pat. No. 5,941,190. That application is assigned to the same assignee as the present invention and is incorporated herein in its entirety by reference.

Figure 2A:
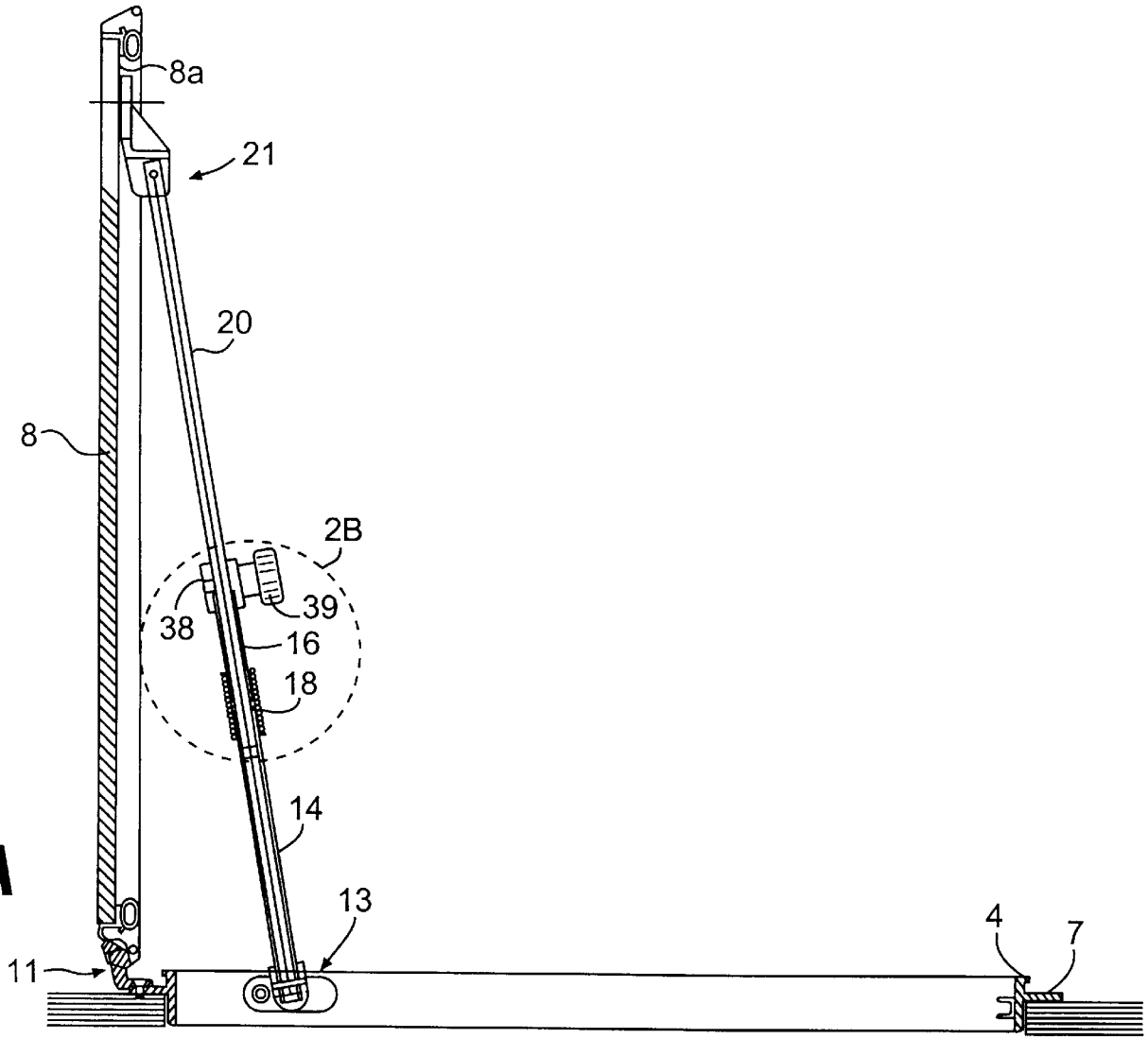
FIG. 2*a* is a cross sectional view of the hatch assembly shown in FIG. 1, but with the hatch in an open position with the hatch cover rotated at about 90°.
Figure 3A:
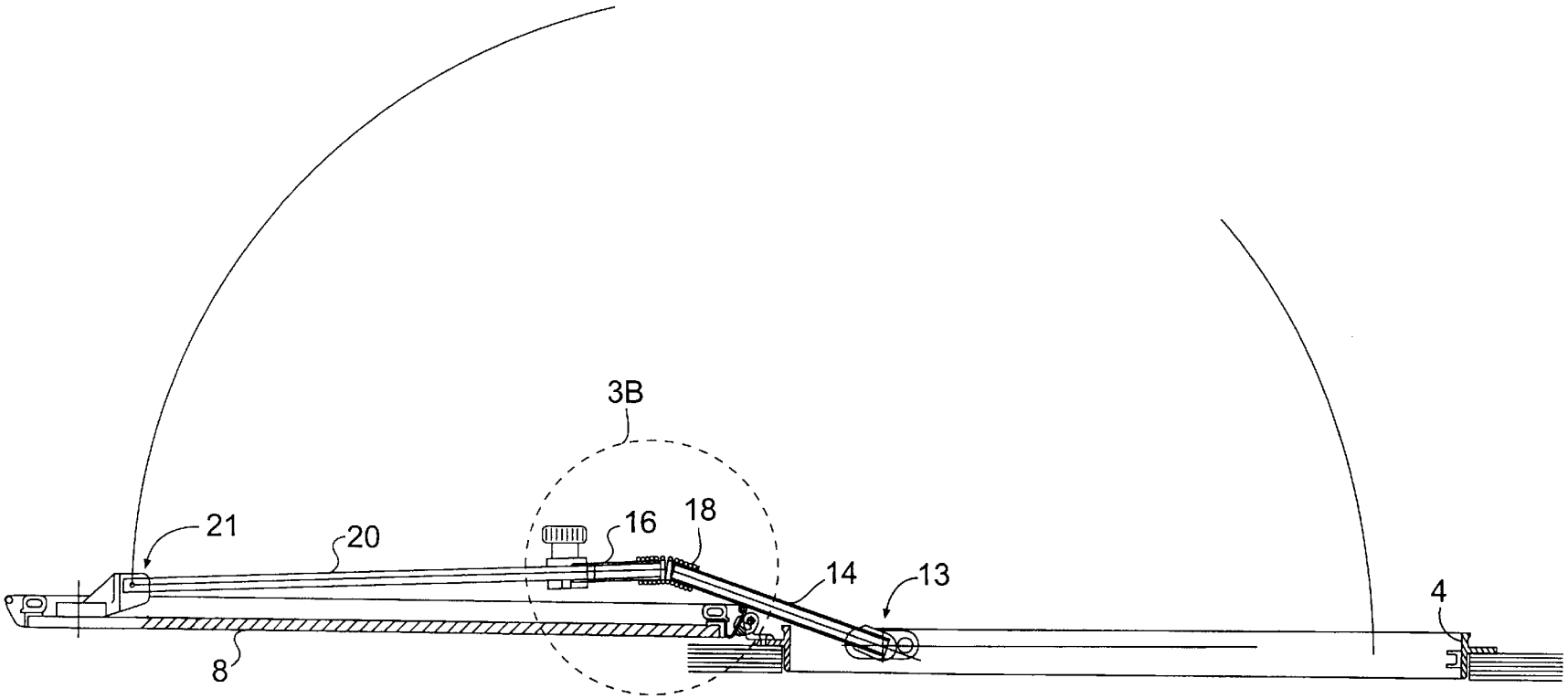
FIG. 3*a* is a cross sectional view of the hatch assembly shown in FIG. 1, but with the hatch in a fully opened position i.e. with the hatch cover rotated to about 180°.

A conventional hinge assembly 11 is fixed to the peripheral segment 7 of the frame 4 and is constructed and arranged to permit the hatch cover 8 to rotate through a 180° angle as illustrated in FIGS. 1, 2*a* and 3*a*. This hinge assembly may also take the form as shown in my aforementioned patent application Ser. No. 08/937,735.

Figure 2B:
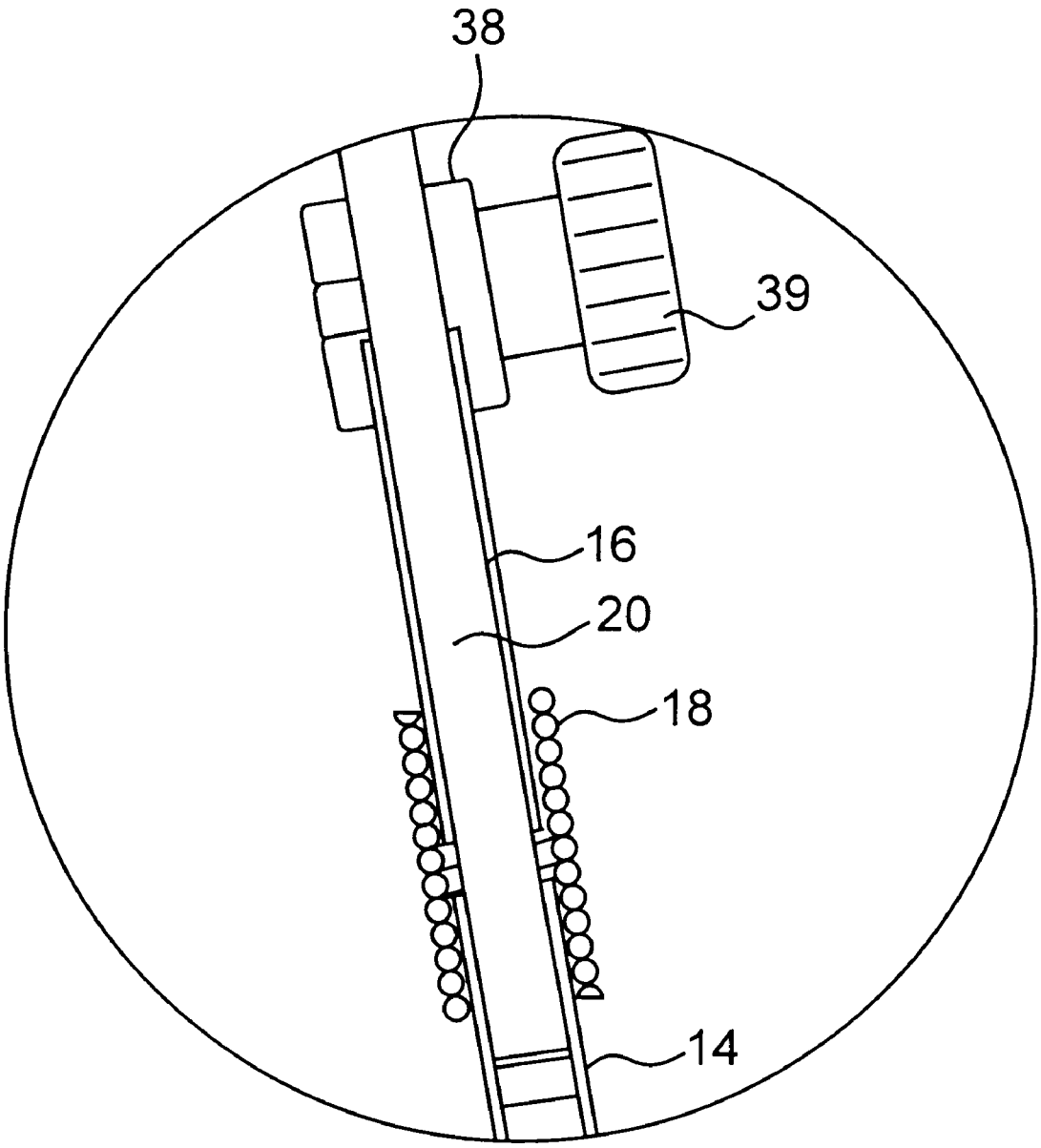
FIG. 2*b* is an enlarged portion of the central part of a hatch adjuster when the hatch assembly is opened to the position shown in FIG. 2*a;*
Figure 3B:
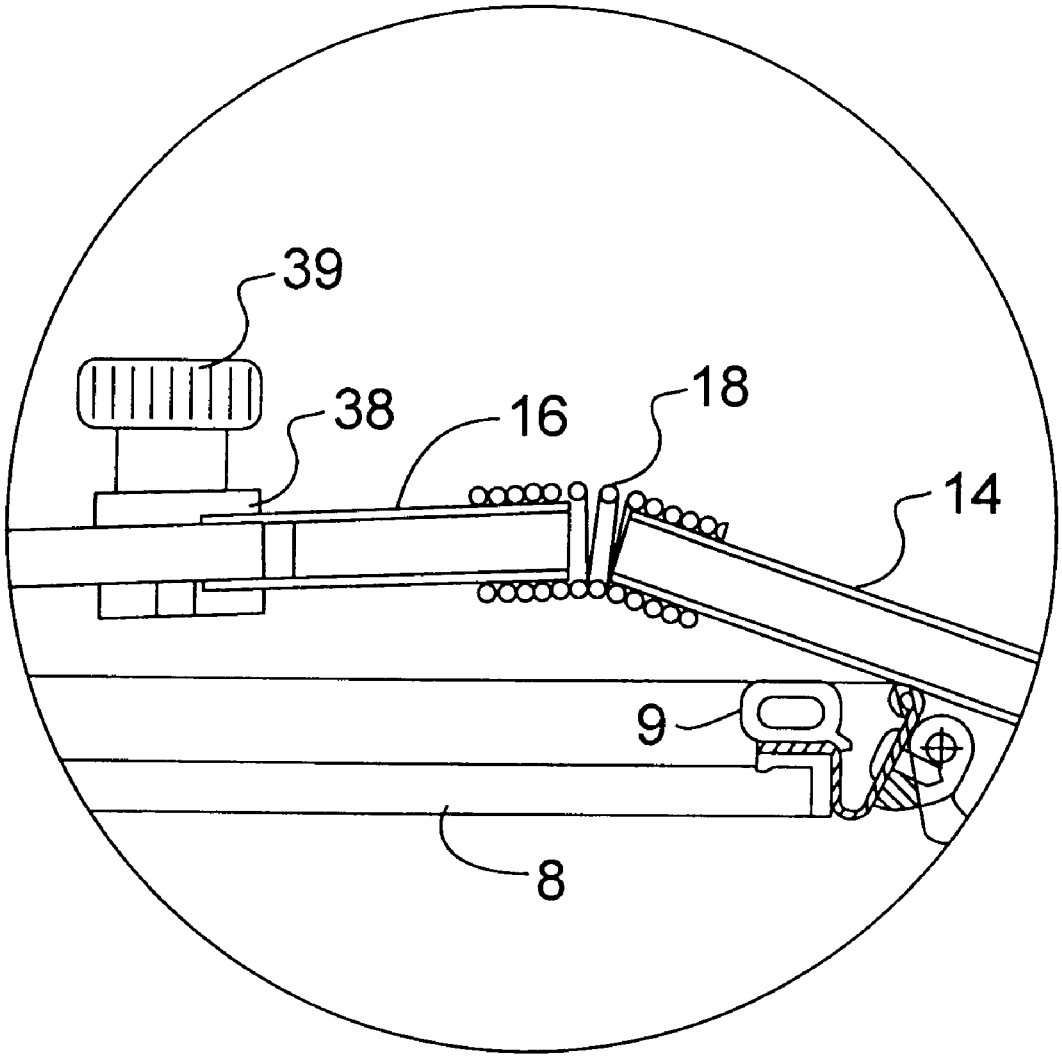
FIG. 3*b* is an enlarged portion of the central part of the hatch adjuster when the hatch assembly is opened to the position shown in FIG. 3*a*.
Figure 4:
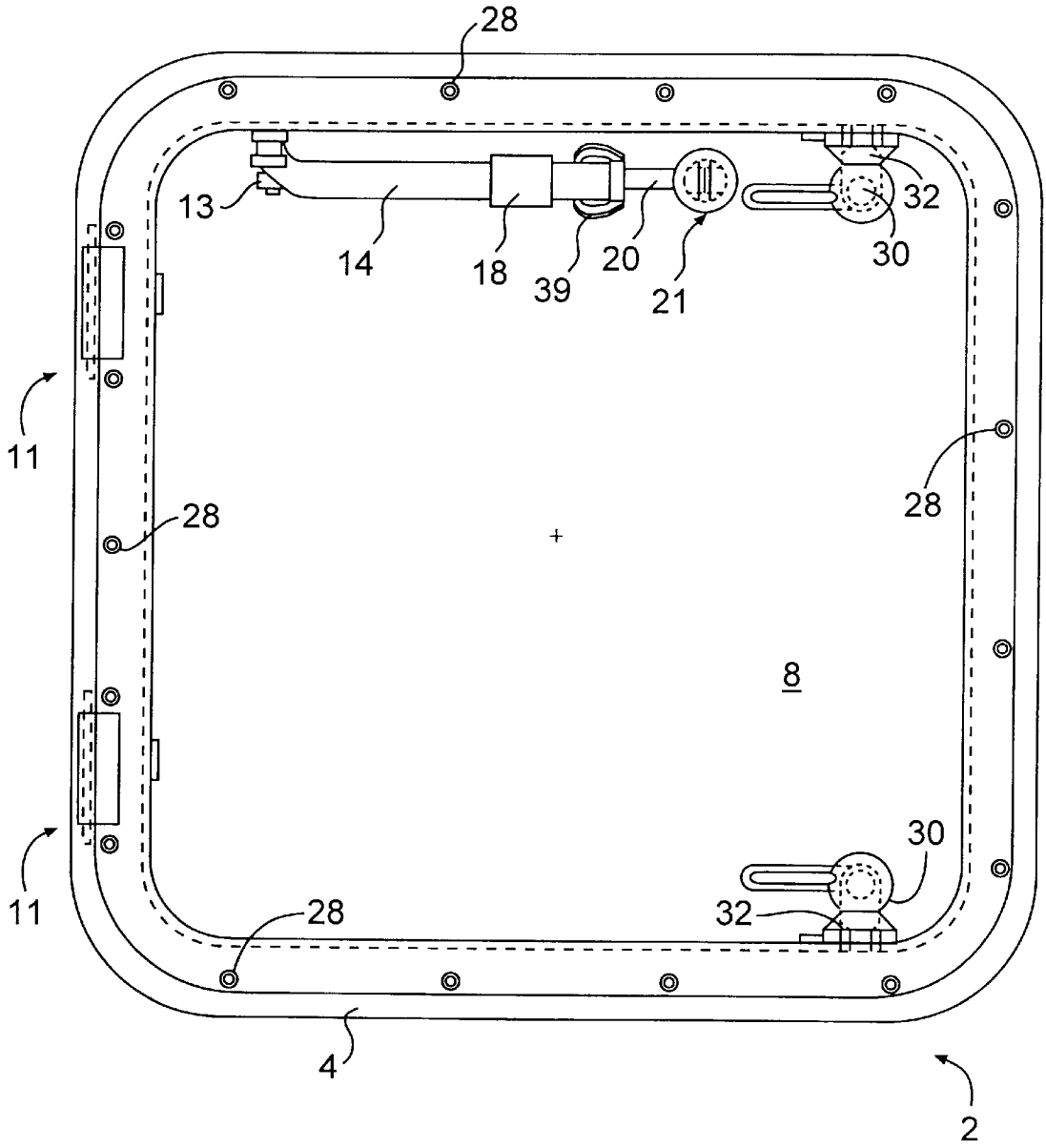
FIG. 4 is a top or plan view which illustrates one embodiment of the invention wherein the hatch cover is in a closed position.

As shown more clearly in FIGS. 1, 2*a* and 3*a*, the hatch assembly 2 also includes an elongated hatch adjuster 12. This hatch adjuster 12 comprises an outer tube 14, a tubular extension 16 and a flexible coupling 18. The flexible coupling 18 may comprise a coil spring as shown in FIGS. 1, 2 and 3 or a tubular elastomeric element as shown in FIG. 4. An elongated rod 20 is slidably received within the outer tube 14 and passes through the tubular extension 16 and flexible coupling 18 in sliding engagement with extension 16.

The hatch adjuster 12 is pivotally fixed to a portion of the frame member 4 by means of a conventional pivotal mounting assembly 13 (see FIG. 4) which connects one end of the outer tube 14 to the frame member 4. In a similar manner, one end of the rod 20 is pivotally mounted to one side 8*a* of the hatch cover 8 by means of a pivotal mounting assembly 21. In practice, the rod 20 is pivotally mounted to hatch cover 8 at a relatively great distance from hinge assembly 11.

Fastening means such as a plurality of metal fasteners on screws 28 (see FIG. 4) are provided for fastening the frame member 4 to the deck of the vessel. These screws 28 pass through a plurality of openings in the segment 7 of the frame member 4. The hatch assembly 2 also includes releasable clamp means such as a conventional rotatable dog 30 and catch member 32 for clamping the hatch assembly in a closed position. The releasable clamp or rotatable dog 30 is then rotated out of engagement with the catch member 32 in order to open the hatch assembly.

A conventional threaded clamping member 38 with a knob 39 is fixed to one end of the extension 16 for securing the hatch cover 8 in a preselected angular position.

In opening and closing the hatch assembly, the rod 20 which extends through the extension 16 and into the outer tube 14 prevents the flexible coupling 18 from flexing or bending as the hatch cover 8 is rotated between the fully closed position through about 135°. Then, as the hatch cover 8 approaches a fully opened position (180°) as shown in FIG. 3*a*, the rod 20 slides out of engagement with the outer tube 14 which permits the flexible coupling 18 to flex or bend as shown in FIGS. 3*a* and 3*b*.

In the preferred embodiment of the invention, the flexible coupling 18 is relatively stiff and capable of maintaining the outer tube 14, extension 16 and rod 20 in axial alignment until the outer tube 14 comes into contact with the frame member 4. Then as the hatch cover 8 is rotated upward from its fully opened position the flexible coupling and rod 20 brings the extension 16 back into axial alignment with the outer tube 14 so that the rod 20 slides back into the outer tube 14.

While the invention has been described in connection with its preferred embodiments, it should be recognized that changes and modifications may be made therein without departing from the scope of the claims

What is claimed is:

1. A hatch assembly having an open and closed position for fitting within an opening in a marine vessel, said hatch assembly comprising:

an outer frame for fitting within an opening in a vessel, a hatch cover and first hinge means for hingedly connecting said cover to said frame on one side thereof for opening and closing the hatch assembly;

an elongated hatch adjuster connected at one end thereof to said frame and at an opposite end thereof to said hatch cover;

said elongated hatch adjuster comprising a telescoping rod assembly including an outer tube, a tubular extension and a flexible coupling connecting said tubular extension and said outer tube in axial alignment, and a rod slidably received within said tube and within said tubular extension;

means for fixing said rod within said outer tube and said tubular extension to thereby fix said rod and said tube in a preselected position with respect to one another to thereby fix said hatch cover in a preselected open or closed position with respect to said frame and for releasing said rod to be withdrawn out of said outer tube but within said tubular extension whereby the bending of said flexible coupling allows the hatch cover to be rotated through an angle of up to 180°.

2. A hatch assembly according to claim 1 in which said outer tube, tubular extension and rod have a generally circular cross section.

3. A hatch assembly according to claim 2 in which said flexible coupling comprises an elastomeric sleeve.

4. A hatch assembly according to claim 2 in which said flexible coupling comprises a coil spring.

5. A hatch assembly according to claim 2 in which said hatch adjuster is hingedly connected at one end thereof to said frame by second hinge means and at an opposite end thereof to said cover by third hinge means.

6. A hatch assembly according to claim 5 which includes sealing means for sealingly engaging said frame and said hatch cover when said hatch cover is in a closed position.

7. A hatch assembly according to claim 6 wherein said adjuster is hingedly connected to said frame relatively close to the axis of rotation of said first hinge means.

8. A hatch assembly according to claim 7 wherein said first hinge means, second hinge means and third hinge means have parallel axes of rotation.

* * * * *